United States Patent [19]

Feinberg

[11] Patent Number: 4,683,594

[45] Date of Patent: Aug. 4, 1987

[54] GARMENT FOR CONVALESCENTS

[76] Inventor: Alixandra Feinberg, 1430 William St., River Forest, Ill. 60305

[21] Appl. No.: 641,168

[22] Filed: Aug. 15, 1984

[51] Int. Cl.[4] ..... A41D 1/22

[52] U.S. Cl. ..... 2/105; 2/69; 2/114

[58] Field of Search ..... 2/114, 105, DIG. 7, 2/74, 76, 69; 128/134; 297/465

[56] References Cited

U.S. PATENT DOCUMENTS

| | | | |
|---|---|---|---|
| 1,489,046 | 4/1924 | Thompson | 2/DIG. 7 |
| 2,520,026 | 8/1950 | Beitchman | 2/DIG. 7 |
| 4,026,282 | 5/1977 | Thomas | 128/134 |
| 4,422,186 | 12/1983 | Loney | 2/114 |
| 4,535,481 | 8/1985 | Larson et al. | 2/114 |

FOREIGN PATENT DOCUMENTS

| | | | |
|---|---|---|---|
| 484510 | 5/1938 | United Kingdom | 2/85 |

*Primary Examiner*—Doris L. Troutman

*Attorney, Agent, or Firm*—Neuman, Williams, Anderson & Olson

[57] ABSTRACT

A functional and attractive garment is provided for convalescents who are confined to wheelchairs and secured therein for safety reasons by a restraining device. The garment features slits at either side, through which strap portions of a pelvic or other wheelchair restraint can be drawn from within to outside of the garment for fastening to the back of the wheelchair; a graduated hemline; and color-coded, detachable sleeves. When used in conjunction with such a restraining device, the garment fits the wearer comfortably and falls gracefully over the wearer's knees, preserving warmth and dignity. The color-coded, detachable sleeves facilitate donning of the garment and can be separated for injections, blood pressure examinations and so forth.

15 Claims, 9 Drawing Figures

GARMENT FOR CONVALESCENTS

BACKGROUND OF THE INVENTION

This invention relates to a garment for convalescents who are confined to wheelchairs and secured therein for safety reasons by a restraining device. More particularly, it relates to a decorative, dignified and highly functional gown which is designed to promote the physical and psychological rehabilitation of convalescents.

In care and rehabilitation institutions, it is common to find invalid patients, particularly elderly persons and stroke victims, confined to wheelchairs. Often, such patients lack upper body strength and cannot control their movements. For example, such patients can slide forward in their wheelchairs, or even turn over their wheelchairs, thereby sustaining injuries. To remedy these problems, various restraining devices have been employed to limit a patient's movement while seated in a wheelchair. A commonly used type of restraining device is a pelvic restraint, which fits underneath a patient's gown and between his or her legs like a diaper; two sets of straps are used to secure the pelvic restraint by buckling or tying behind the wheelchair.

When pelvic restraints are used with women convalescents wearing dresses or hospital gowns, the skirts of their dresses and gowns overlap the restraint straps such that the woman's lower back and thigh regions remain exposed. Moreover, the skirts do not fall gracefully over her knees and have a tendency to creep upward toward her hips, revealing private parts of the body. Where there remain exposed body parts, a woman convalescent is not provided with sufficient warmth and, further, is susceptible to abrasions and skin irritation caused by the rubbing of straps or the wheelchair itself against her skin. Thus, conventional dresses and hospital gowns have been less than satisfactory for use by such women convalescents.

One proposed solution to these problems has been to request that women confined to wheelchairs wear slacks. This solution is unavailable, however, to patients who suffer from increased pain as can be caused by lifting their legs into a pair of slacks. Also, many women find slacks less comfortable than a dress. Still other, and particularly elderly, women consider it improper or distasteful to wear slacks. Furthermore, when used with slacks, the pelvic restraint devices show, causing the patient to feel more self-conscious and helpless, and thus making the patient harder to rehabilitate. A second solution has been to provide a lap robe to women convalescents. These lap robes, however, frequently come untied and fall from the patient's lap. These alternatives, while addressing the basic problems, are less than desirable because they fail to provide the self-esteem and femininity accorded a woman by a pretty dress and required for complete rehabilitation.

SUMMARY OF THE PRESENT INVENTION

It is an object of the present invention to provide a decorative, dignified and highly functional clothing garment which is designed to promote the physical and psychological rehabilitation of convalescents. More specifically, it is an object to provide a dress for women convalescents confined to wheelchairs, specifically designed for maximum utility, safety, comfort and beauty.

It is another object to provide a dress which does not look like a hospital gown and which, while attractive in appearance, is unconventionally constructed so as to facilitate its use with a variety of fabric restraining devices commonly used to restrain convalescents in wheelchairs.

It is still another object of the present invention to provide a dress having color-coded, detachable sleeves to facilitate the clothing and unclothing of women convalescents with restricted arm and shoulder movements, such as stroke victims.

It is still another object of the invention to provide an inexpensive, aesthetic and functional convalescent dress which is not limited in use to a particular stage of rehabilitation.

It is yet another object of the invention to provide a clothing garment which facilitates the restraint of a patient in a wheelchair, thereby preventing injury.

These and other objects of the invention will be apparent hereinafter from the specification which describes the best mode of practicing the invention as currently known, its fabrication and use, and a preferred embodiment. Reference should also be made to the drawings, which constitute a part of the disclosure, and the subject matter claimed.

Generally, the objects of the present invention are accomplished in a dress having a pair of slits, at each side and near the waistline, through which strap portions of a pelvic or other wheelchair restraint can extend from within to outside of the dress for fastening to the back of the wheelchair. This feature of the invention eliminates the unsightly and undesirable circumstance of the woman's dress hanging over the straps, and thereby exposing her lower back and thighs. Additionally, a longer front hemline on the dress, while helping to avoid bunched up material between the wearer's back and the wheelchair, further enables the dress to hang gracefully over the wearer's knees, thereby providing warmth to the joints. Also, the color-coded, detachable sleeves of the present invention assist both aides and patients themselves in quickly getting the patient dressed. The individual sleeves can be separated without moving the wearer's arm in order, for example, to give the wearer an injection or take the wearer's blood pressure. This aspect of the invention is particularly important in light of the fact that many patients develop frozen shoulders, making movement of the arms painful.

While the invention disclosed herein has been described primarily with reference to a woman's dress, it is to be understood that it is within the scope of the invention to also provide a convalescent gown for men which incorporates the same novel features.

BRIEF DESCRIPTION OF THE DRAWINGS

For a more complete understanding of this invention, reference should be made to the drawings, as briefly described below.

DESCRIPTION OF THE PREFERRED EMBODIMENT

Figure 1:
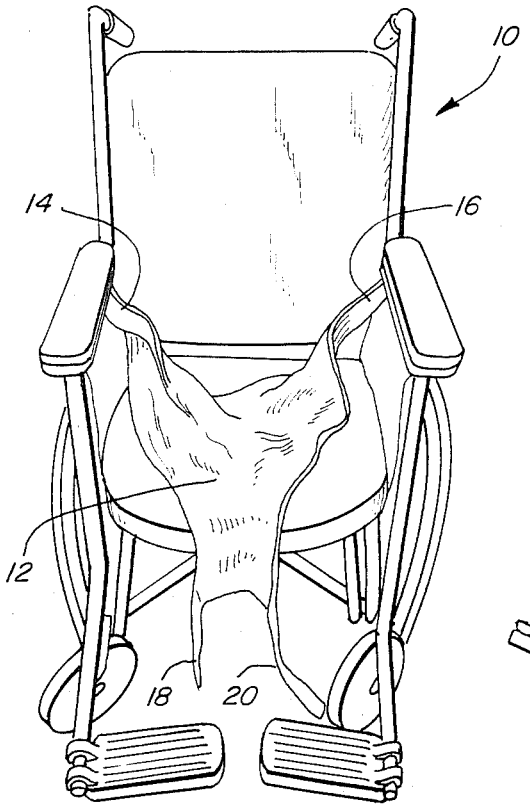
FIG. 1 is a front view of a wheelchair with a conventional, fabric pelvic restraint partially strapped thereto.

Referring now to FIG. 1, a typical wheelchair 10 is illustrated, with a conventional pelvic restraint 12 partially secured thereto by straps 14 and 16. The illustrated pelvic restraint 12 is of the fabric type sold by the J. T. Posey Company of Arcadia, Calif. In use, the unfastened straps 18 and 20 are drawn upward between the convalescent's legs and tied around the convalescent's waist to the back of the wheelchair. The convalescent's gown, dress or other garment is worn over the restraint 12. Thus, if soiled, the pelvic restraint 12 can be replaced without changing the convalescent's clothing.

For this and other reasons, a separate restraining device and clothing article are preferred to a patient restraining gown of the type disclosed in U.S. Pat. No. 4,026,282 to Thomas. Gowns with attached restraining belts fail to secure the buttocks and pelvic areas where the possibility of slippage from the wheelchair is greatest. The gown can easily rip away from the securing belts. The present invention provides a comfortable and aesthetic convalescent dress without sacrificing the protection and security accorded by conventional restraint devices.

The pelvic restraint is the most common wheelchair restraining device, although it is also known to use other fabric restraints for specific applications; e.g. chest restraints are used where additional upper body support is required. It will be appreciated that the garment of the present invention can accommodate a number of different types of restraining devices.

Figure 2:
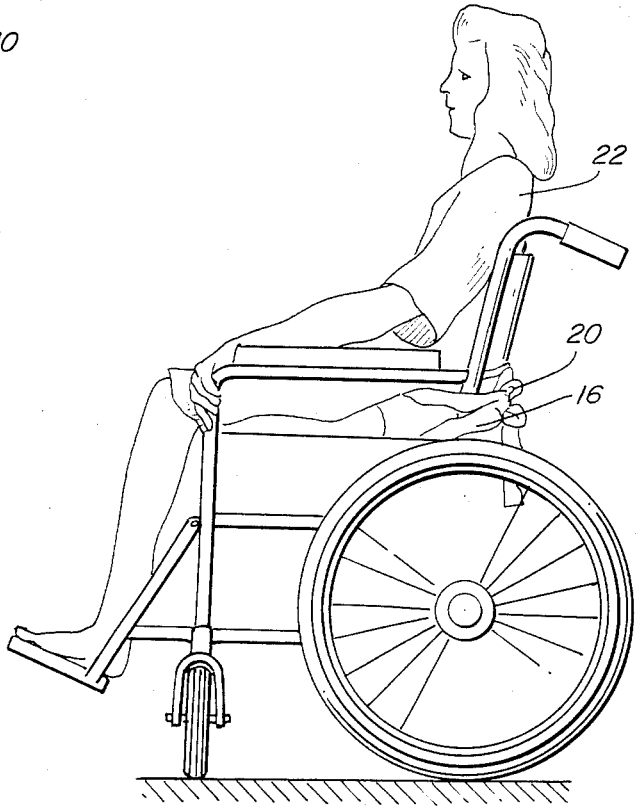
FIG. 2 is a side view of a woman convalescent seated in a wheelchair and wearing a conventional dress.

Referring now to FIG. 2, and using like numbers to designate like items to assist in understanding the several views, a wheelchair-bound woman, shown wearing a conventional dress 22, is secured to a wheechair 10 by the pelvic restraining device 12 of FIG. 1. Disadvantageously, the rear skirt of the woman's dress is bunched up and resting upon the top of strap 20, exposing the woman's lower back to the atmosphere and to possible abrasion from the wheelchair back. Additionally, it has been observed that the front skirt of dresses so worn have a tendency to creep up over the woman's knees, as can be seen in FIG. 2. Combined with the bunched up back, the creeping front skirt tends to expose portions of the woman's buttocks, thighs and private regions. This phenomenon frequently necessitates the use of unsightly lap robes to provide additional coverage and warmth for the wheechair-bound patient.

Figure 3:
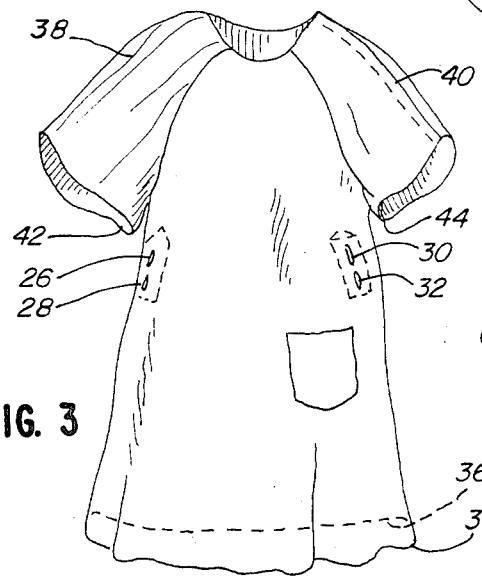
FIG. 3 is a front elevation view of a dress fabricated according to the present invention.
Figure 4:
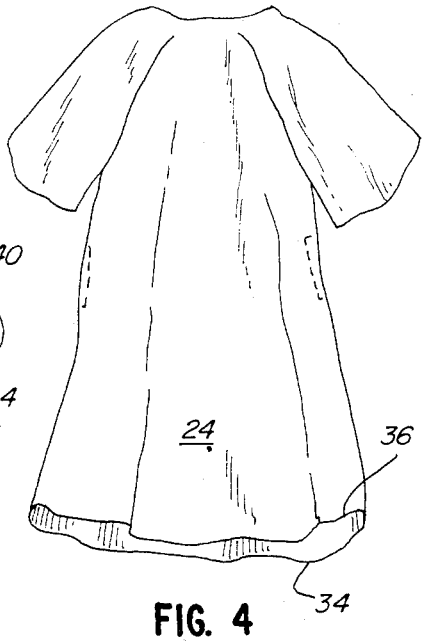
FIG. 4 is a rear elevation view of a dress fabricated according to the present invention.
Figure 5:
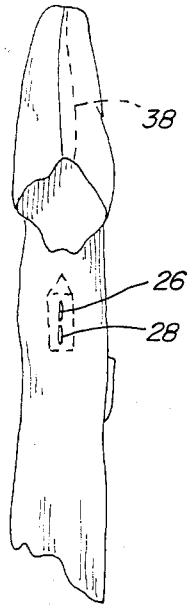
FIG. 5 is a side elevation view of a dress fabricated according to the present invention.

In keeping with the aforestated objectives, and to avoid the demeaning circumstance illustrated in FIG. 2 and previously described herein, a dress 24 is provided as illustrated in FIGS. 3–5. In the preferred embodiment, dress 24 is characterized by a first pair of openings or slits 26 and 28 on one side of the dress, and a second pair of openings or slits 30 and 32 on the other side of the dress. Dress 24 is further characterized by a graduated hemline. Thus, the front skirt portion of the dress defines a front hemline 34 and the rear skirt portion defines a higher rear hemline 36. Additionally, dress 24 includes a right sleeve detachable along line 38 and a left sleeve detachable along line 40.

It will be appreciated that the location and number of slits in dress 24 can vary depending on the restraining device with which the dress is to be used. The four slits 26, 28, 30 and 32 of FIG. 3 are intended to receive the four straps 18, 14, 20 and 16, respectively, of the pelvic restraint 12 of FIG. 1. For this application, it has been determined that the slits 26 and 30 should be approximately $6\frac{1}{2}$ inches from the underarm seams 42 and 44, respectively. Each longitudinal slit opening, in the preferred embodiment, is $1\frac{1}{2}''$ long with $\frac{1}{2}''$ length between the two slits.

Figure 6A:
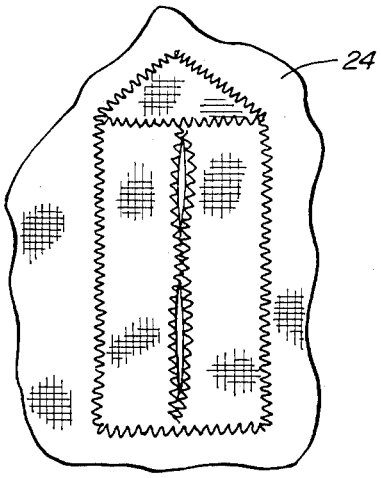
FIG. 6*a* is an enlarged view of the dress slits of the present invention, as seen from outside of the dress.
Figure 6B:
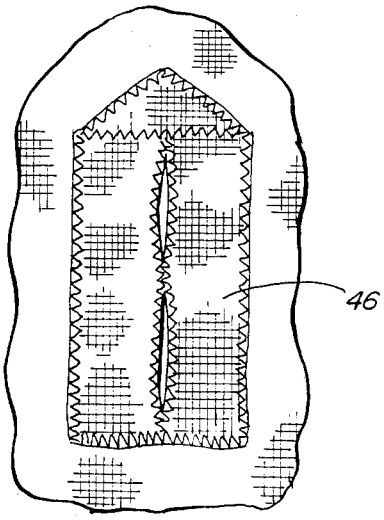
FIG. 6*b* is an enlarged view of the dress slits of the present invention, as seen from the inside of the dress, showing the reinforcing webbing affixed thereto.

Due to the increased stress points caused by the slits, it is desirable to reinforce the slits with a strong binding material, as shown in FIGS. 6*a* and 6*b*. The binding material 46 can be any strong material suitable for the purpose of strengthening the dress regions adjacent to the slits, including without limitation sailcloth or heavy cotton webbing. A tight zig-zag stitch has been found to satisfactorily affix the binding material 46 to the inside of dress 24, and thereafter reinforce the slits themselves. Other stitches, as well as adhesives, perform a similar function.

Referring back to FIGS. 3–5, it will be observed that front hemline 34 is closer to the ground than rear hemline 36. The lower overall length of the skirt portion of dress 24 insures that the convalescent wearer's knees will be covered, that sufficient warmth will be provided and that the wearer's body parts will be protected against awkward display. The higher rear hemline 36 eliminates excess material in the back of the dress which can cause discomfort to persons sitting in a wheelchair. Such excess material can also overlap the sides of a wheelchair, and thereby interfere with the wheels or access to the wheels of the wheelchair. On the other hand, the rear of the dress should be long enough that it does not rise so far as to display the wearer's buttocks area when the wearer stands, usually leaning forward with the help of a walker or cane. The graduated hemline of the present invention is intended to address these considerations. It has been determined that an appropriate variation of height between front hemline 34 and rear hemline 36 is approximately two to three inches.

Figure 8:
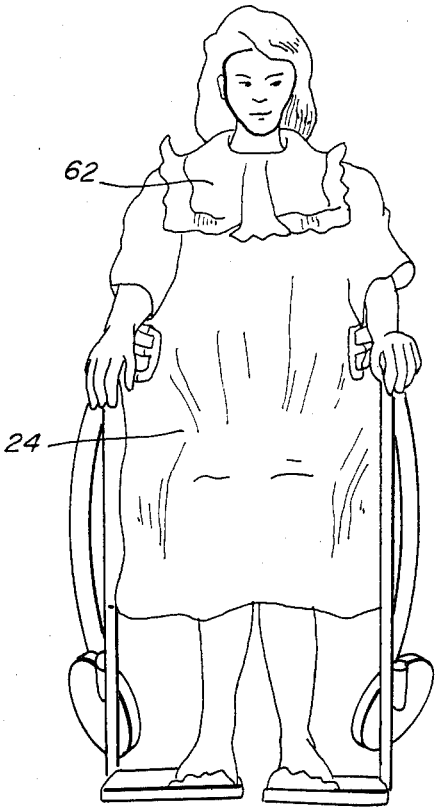
FIG. 8 is a front view of a woman convalescent seated in a wheelchair and wearing a dress fabricated according to the present invention, showing a bib accessory garment.
Figure 7:
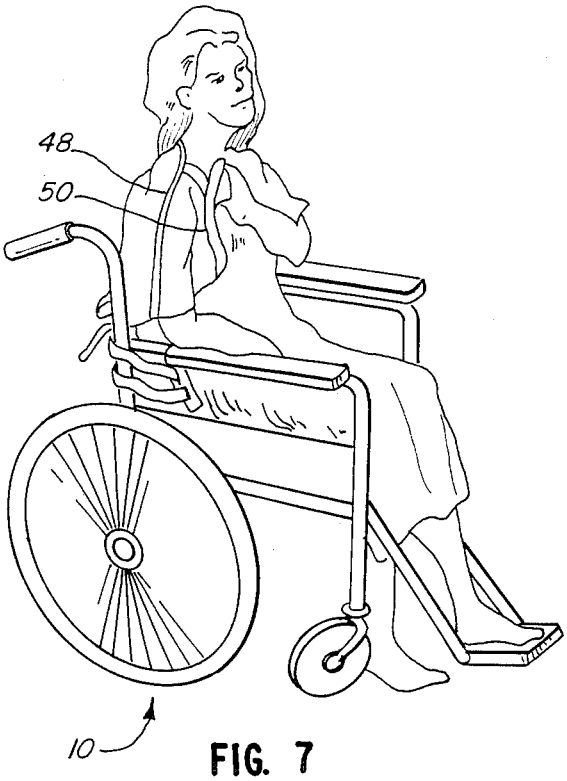
FIG. 7 is a perspective view of a woman convalescent seated in a wheelchair and wearing a dress fabricated according to the present invention, showing a right detachable sleeve.

Referring now to FIGS. 7 and 8, a wheelchair-bound woman, shown wearing dress 24, is secured to a wheelchair 10 by the pelvic restraining device 12 of FIG. 1. In sharp contrast to the use of a conventional dress 22, as shown in FIG. 2, the woman in FIGS. 7 and 8 is seen to be comfortably seated with dignity in wheechair 10. Dress 24 falls gracefully over her knees and all body parts are covered without necessity of a lap robe.

Referring more specifically to FIG. 7, the aforementioned right detachable sleeve is shown separated from the neck down. Although there exist a number of suitable means to refasten the sleeve, it has been found preferable to utilize a pair of cooperating self-adhering fabric strip members 48 and 50 as, for example, Velcro fasteners, such strip members being affixed to the detached portions of the sleeve. The left sleeve of dress 24, not fully shown in FIG. 7, is constructed in the same manner.

To avoid having a loose dress that might otherwise appear to be an awkward shape of material, it has been found advantageous to color-code the fabric strip members on each sleeve or the sleeves themselves. This color-coding assists the wearer or her aides in efficiently orienting and donning the dress. Consistent with industry convention, the color red has been selected to designate the right side of the dress.

The described detachable sleeves can be opened to facilitate nursing care, as well as the donning or unclothing, of the patient with minimal arm and shoulder movement. Thus, injections, blood pressure testing, EKGs and so on are readily performed without removal of the entire dress and without the wearer having to extricate her arm from the sleeve, frequently a painful maneuver for patients suffering from a frozen shoulder or other similar physical limitation.

All of the described features of dress 24 and the dress itself, are fabricated from approximately 6 yards of material. This is in contrast to the standard 2 to 2¼ yards of material found in the housecoats and conventional dresses which are ordinarily used under the above circumstances. The dress therefore is more roomy and comfortable.

In this same connection, it has been found desirable to use a material which is wrinkle-free, breathable and colorfast. A material which transports perspiration is important because infirm and aged persons must avoid skin breakdown from moisture. A colorfast material insures that the dress will retain its beauty, thus performing its psychological rehabilitative function. Also, since one anticipates frequent laundering of clothing articles used in this application, and because many infirm and aged persons are on a limited budget, wear and tear is another important factor in selecting a suitable fabric. One fabric which has been found particularly suitable for use in this invention is Visa fabric, manufactured by Milliken and Company in New York.

Consistent with the progressive design of the dress, it is envisioned that a number of accessories can be used therewith to enhance the dress' practicality and beauty. For example, FIG. 8 shows a bib 52 designed for use with dress 24. Such a bib or collar could be connected to the back of the dress neck by Velcro fastening means.

From the description thus far provided, it is apparent that the proposed dress may be used with a variety of restraining devices and that a number of modifications can be made in the invention disclosed, by those having the benefit of the foregoing teachings, without departing from the spirit and scope of these principles. Accordingly, while the invention disclosed herein has been described with reference to an illustrated embodiment of the presently contemplated best mode for practicing the invention, it is intended that this invention be limited only by the scope of the appended claims.

What is claimed is:

1. A dress-like garment suitable for dignified wear in public for use by a convalescent wearer confined to a wheelchair and secured therein for safety reasons by a restraining device distinct from the dress-like garment, said restraining device having strap portions which are intended to be fastened to such wheelchair, said dress-like garment comprising a body portion, a sleeve portion including an underarm seam, and opening means within the body of said garment through which such strap portions of such restraining device can extend from within to outside of said garment for fastening such restraining device to such wheel chair, said opening means located approximately 6½ inches from the underarm seam of said garment, said garment substantially concealing the restraining device while covering the wearer so as to be suitable for dignified wear in public.

2. A garment as defined in claim 1, said body portion comprising:

a front skirt portion extending from the garment waistline downwardly to a lower edge defining a front hemline; and a rear skirt portion extending from the garment waistline downwardly to a lower edge defining a rear hemline; said rear hemline being a lesser distance below said waistline than said front hemline.

3. A garment as defined in claim 2, wherein said front hemline is about 2½ inches lower from said waistline than said rear hemline.

4. A garment as defined in claim 2, wherein said front skirt portion covers the wearer's knees when the wearer is seated in such wheelchair.

5. A garment as defined in claim 2, wherein said rear skirt portion covers the wearer's buttocks area when the wearer is standing, as with a walker.

6. A garment as defined in claim 1, wherein said opening means comprises at least one slit near each side of said garment through which strap portions of such restraining device can extend from within to outside of said garment for fastening such restraining device to such wheelchair.

7. A garment as defined in claim 6, wherein said slits are reinforced to avoid fraying of said garment.

8. A garment as defined in claim 1, wherein said opening means comprises a pair of longitudinal slits located at each side of said garment near the waistline thereof.

9. A garment as defined in claim 1, said sleeve portion comprising detachable sleeves to facilitate the donning thereof and to permit the giving of injections and taking of the wearer's blood pressure with minimal movement of the wearer's arms.

10. A garment as defined in claim 9, wherein said detachable sleeves are color-coded to distinguish right from left.

11. A garment as defined in claim 9, wherein the detached portions of said sleeves are secured by a pair of cooperating self-adhering fabric strip members, said strip members being affixed to the detached portions of said sleeves.

12. A decorative and dignified dress for use by a convalescent female wearer confined to a wheelchair and secured therein for safety reasons by a restraining device which is intended to be fastened to such wheelchair, comprising:

a front skirt portion extending from the dress waistline downwardly to a lower edge defining a front hemline, said front skirt portion covering the wearer's knees when the wearer is seated in such wheelchair;

a rear skirt portion extending from the dress waistline downwardly to a lower edge defining a rear hemline, said rear hemline being a lesser distance below said waistline than said front hemline;

a pair of longitudinal, reinforced slits located at each side of said dress near said waistline through which strap portions of such restraining device can extend from within to outside of said dress for fastening such restraining device to, and securing such wearer in, such wheelchair; and color-coded detachable sleeves to facilitate the donning of said dress and to permit the giving of injections and taking of the wearer's blood pressure with minimal movement of the wearer's arms.

13. A dress-like garment for use by a convalescent wearer confined to a wheelchair and secured therein for safety reasons by a restraining device having strap portions which are intended to be fastened to such wheelchair, comprising a front skirt portion extending from the dress waistline downwardly to a lower edge defining a front hemline, said front skirt portion covering the wearer's knees;

opening means within the body of said garment through which such strap portions can extend from within to outside of said garment for fastening such restraining device to such wheelchair, said opening means approximately $6\frac{1}{2}$ inches from the underarm seam of said garment;

a rear skirt portion extending from the dress waistline downwardly to a substantially straight lower edge defining a rear hemline, said rear hemline being a lesser distance below said waistline than said front hemline.

14. The garment of claim 13 wherein said opening means comprises a pair of longitudinal slits located one on each side of said garment.

15. The garment of claim 14 wherein said slits are $1\frac{1}{2}$ inches long and about $\frac{1}{2}$ inch wide.

* * * * *